United States Patent [19]

Yang

[11] Patent Number: 4,768,777

[45] Date of Patent: Sep. 6, 1988

[54] DOUBLE FUNCTIONAL EXERCISE BIKE FOR EXERCISE AND TRAINING

[76] Inventor: Tai-Her Yang, 5-1, Tai-Pin Street, Si-Hu Town, Dzan-Hwa, Taiwan

[21] Appl. No.: 896,057

[22] Filed: Aug. 13, 1986

Related U.S. Application Data

[62] Division of Ser. No. 640,775, Aug. 14, 1984, Pat. No. 4,616,823.

[51] Int. Cl.[4] ..... A63B 23/04

[52] U.S. Cl. ..... 272/73; 272/134

[58] Field of Search ..... 272/73, 134

[56] References Cited

U.S. PATENT DOCUMENTS

| | | | |
|---|---|---|---|
| 629,746 | 7/1899 | Grosset | 272/73 |
| 1,513,251 | 10/1924 | Kennedy | 272/73 |
| 1,525,278 | 2/1925 | Doglione | 272/73 |
| 1,909,002 | 5/1933 | Oehlberg | 272/73 |
| 2,474,370 | 6/1949 | Russell | 74/572 |
| 2,735,422 | 11/1954 | Jones . | |
| 3,210,634 | 10/1965 | Stern . | |
| 3,240,947 | 3/1966 | Mas . | |
| 3,727,913 | 4/1973 | Glaser et al. | 272/73 |
| 3,991,749 | 11/1976 | Zent . | |
| 4,141,630 | 2/1979 | Emmons . | |
| 4,291,872 | 9/1981 | Brilando et al. . | |
| 4,298,893 | 11/1981 | Holmes | 272/73 |
| 4,358,105 | 11/1982 | Sweeney, Jr. . | |
| 4,423,863 | 1/1984 | Figueroa . | |

*Primary Examiner*—Leo P. Picard

*Attorney, Agent, or Firm*—Cushman, Darby & Cushman

[57] ABSTRACT

A double functional exercise bike for exercise, training, rehabilation, and human interaction having two chairs, two handle bar frames, and two sets of pedals to provide rotating forces in opposite directions to commonly drive a damping device or generator and having an adjusting device to adjust the tension between driving system elements. The bike also includes at least one operational reaction training device and can include a dynamotor for producing electric power to be used as a driving device. The bike can embody a five-axle or a three-axle structure each with swing-type adjusting devices. The five-axle and the three-axle structure also having driving systems including drive and driven gears, at least two chain wheels and a chain, and a damping device such as a flywheel.

12 Claims, 15 Drawing Sheets

Fig. 13
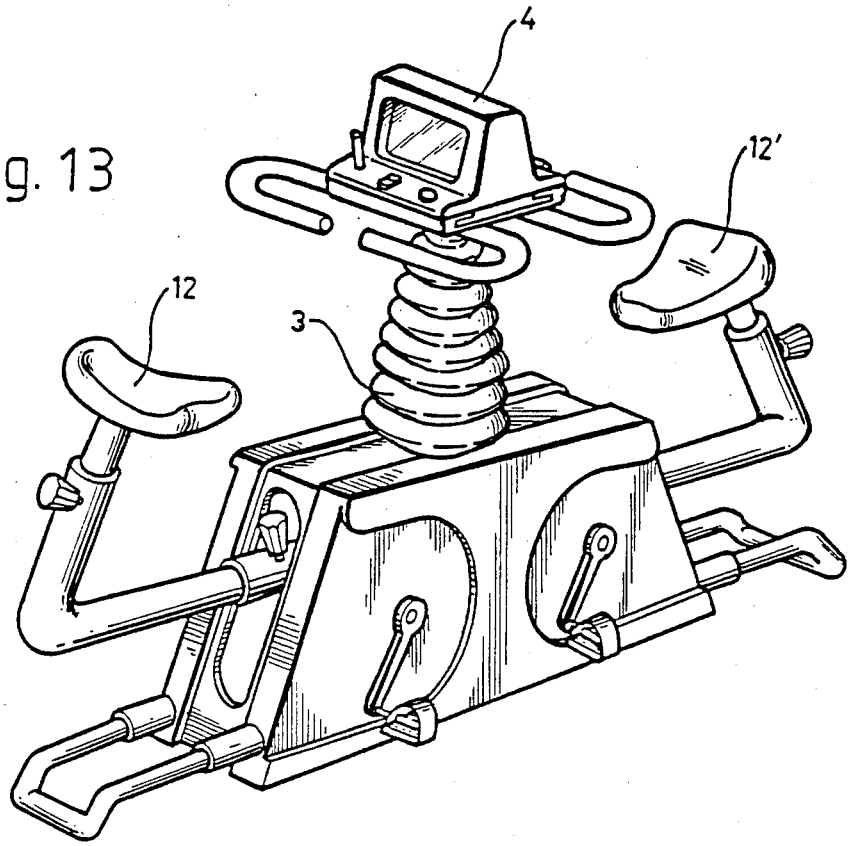
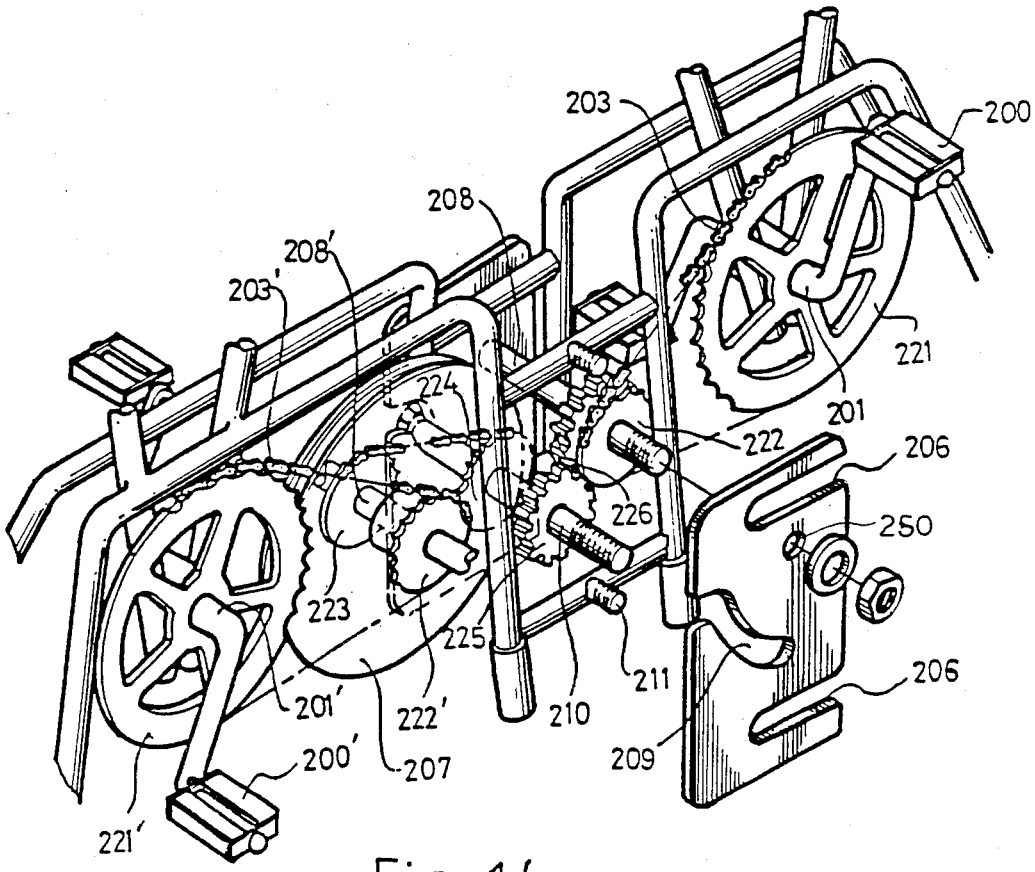
Fig. 14

DOUBLE FUNCTIONAL EXERCISE BIKE FOR EXERCISE AND TRAINING

This is a divisional of U.S. Pat. No. 4,616,823 (Ser. No. 640,775), filed Aug. 14, 1984.

SCOPE OF THE INVENTION

It is limited in the range of exercise bikes.

BACKGROUND OF THE INVENTION

The present invention is provided to promote the entertainment of indoor sporting equipments and rise the exercise interest of people.

SUMMARY OF THE INVENTION

This is an improved design of double functional exercise bike for exercise and training which relates to the active motion and passive motion of muscle reaction and mental establishment of human relation, and rehabilitation; it comprises by a stationary main body of a bike frame on which there is a reclining and sitting chair, frictional fly wheel which is used to produce damping, dynamotor set which is coupled by pedal driving element in order to produce electric power and to be used as driving source, manual operational reaction training device, and auxiliary chair which is provided for the second one to join in and can promote entertainment of this multi-functional sport equipment.

BRIEF DESCRIPTION OF THE DRAWING

FIG. 13 is a structural graphic view of embodiment which possesses double driving and common reaction training device.

FIGS. 14-1–14-2 are the graphic views of five-axle double driving and transfer adjusting structure.

FIGS. 14-3–14-4 are the graphic views of five-axle double driving and transfer adjusting structure.

FIGS. 15-1–15-2 are the graphic views of five-axle double driving and swingable adjusting structure.

FIGS. 16-1–16-2 are the graphic view of double driving tri-axle driving structure.

FIGS. 17, 17-1 and 17-2 are graphic views of round thin plate cup-shaped fly wheel structure.

FIGS. 18–18-1 is a graphic view of seal ring structure.

FIG. 19-1 is a perspective view of hollow flywheel.

DETAILED DESCRIPTION OF THE INVENTION

The present invention relates to a reclining and sitting active passive gymnastic equipment, especially it is used for muscle reaction, active pedaling, passive rehabilitation, and reaction training.

Accordingly, conventional exercise bike is simply pedaling by damping wheel and assemble single chair on the supporting rod, supporting rod is inserted into cylindrical supporting axial tube with larger diameter and is only used to adjust the height of position for the pedalling motion in sitting.

The design of the present invention is that the height of chair and distance between chair and handle can be adjusted for the selection of reclining and sitting, and can provide active pedalling, and passive driven and can pull muscle of leg and possess function of active and passive training or rehabilitation, and traditional exercise bikes only possess single chair and can not let the second one to join in the activity, it is lack of entertainment and can not make reaction training in pedalling, therefore, it becomes a bore thing for a long time and cause low using rate, but the present invention can make exercise of limbs and reaction training, it is full of interest and can harmonize the motor nerve and further possess auxiliary chair for the second one to join in the exercise and can promote the human relation, rehabilitation, and reaction training and let brain and body exercise in the same time, seat is easy to be adjusted.

Main character of the present invention is that the present invention is constituted by a set of stationary main body of bike frame on which there is a reclining and sitting chair, frictional fly wheel which is used to produce damping, dynamotor set which is coupled by pedal driving element in order to produce electric power and to be used as driving source, manual operational reaction training device, and auxiliary chair which is provided for the second one to join in and can promote entertainment of exerciser.

Figure 1:
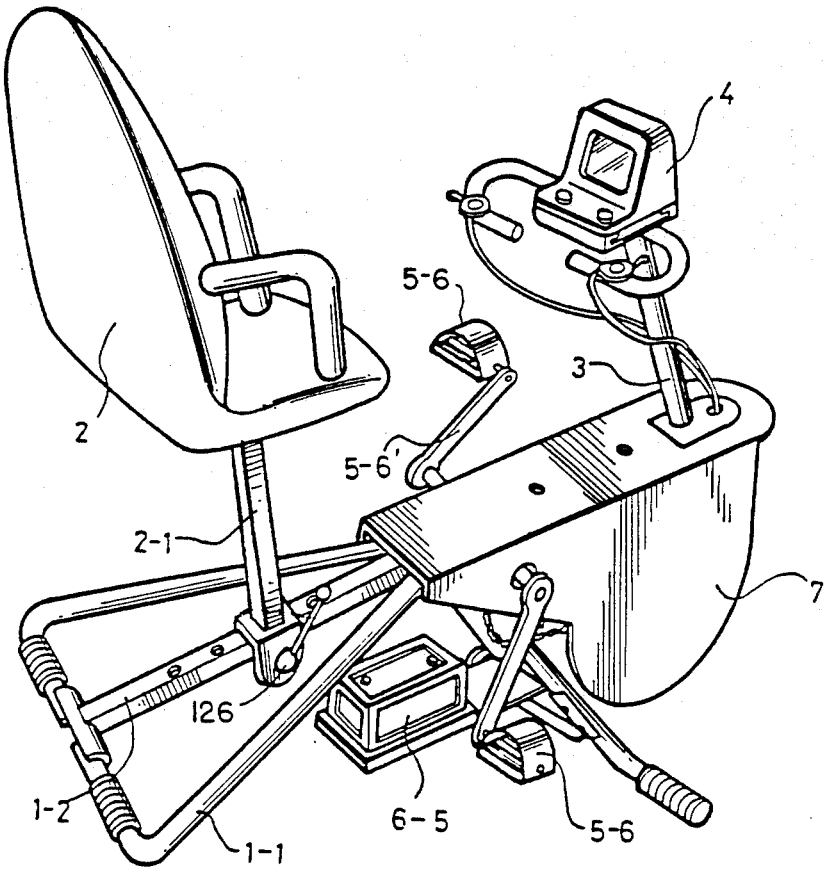
FIG. 1 is a graphic view of embodiment A of the reclining and sitting active passive exercise bike.
Figure 2:
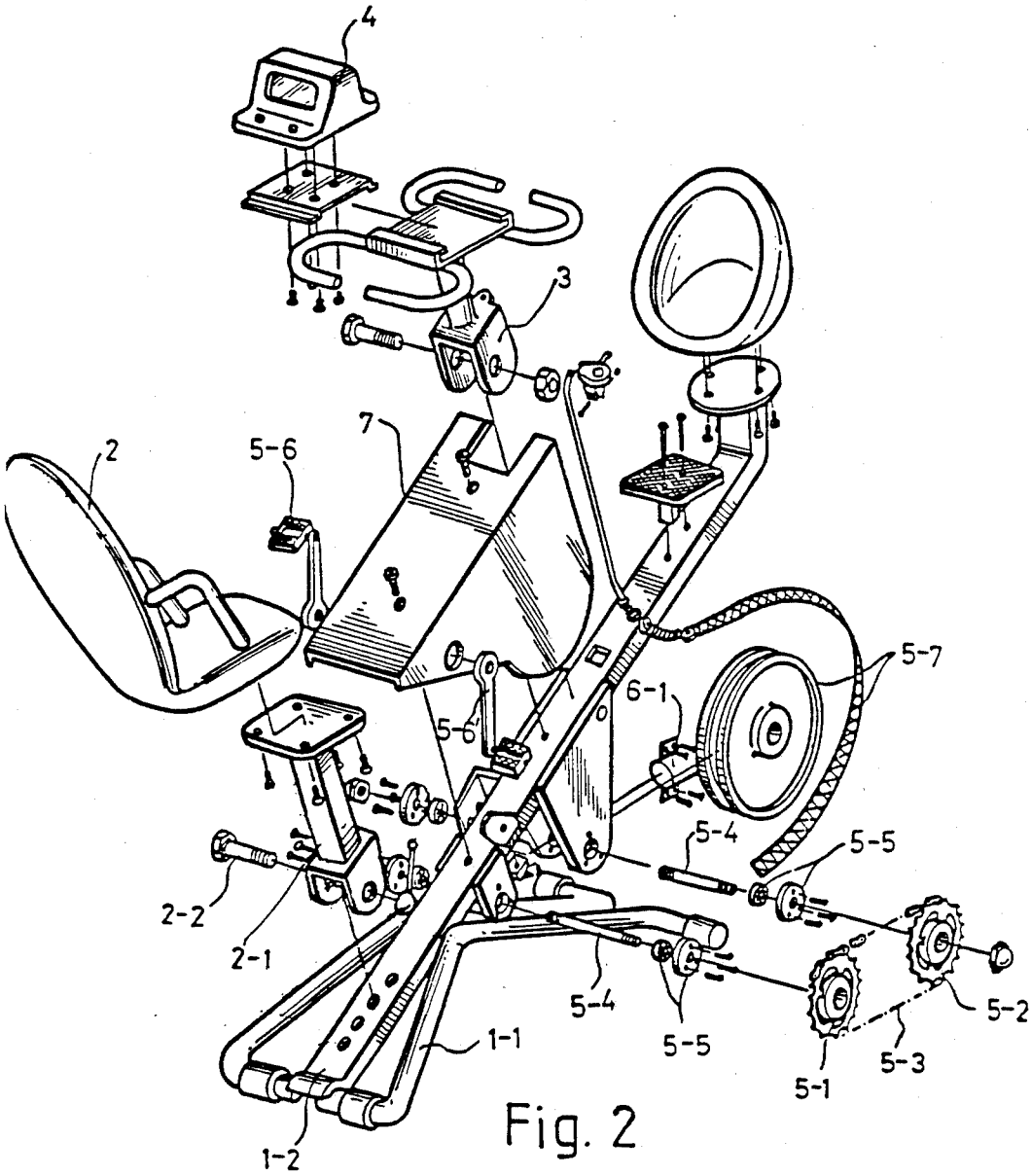
FIG. 2 is a graphic view of embodiment B of the reclining and sitting active passive exercise bike.

Accompanying with the drawings the preferred embodiments of the present invention are described as follows:

As shown in FIGS. 1 and 2, it is the embodiment of reclining and sitting, active and passive exercise bike of the present invention which includes a set of bike frame main body which is stationed on the ground, and said bike frame main body possesses main bar 1-1 and sub-bar 1-2, said sub-bar 1-2 is fixed and jointed on the main bar 1-1, and is used to support main bar 1-1 and seat 2, and is screwed by screw on the handle bar 3 of main bar 1-1; manual operational reaction training device 4 is fixed on handle bar 3, and a set of pedal driving element which is pivoted by driving axle 5-4 and ball bearing 5-5 on bike frame main body, and said pedal driving element possesses drive chain wheel 5-1, driven chain wheel 5-2, chain 5-3 which is used to drive about two chain wheels 5-1, 5-2, and pedal 5-6 and crank set 5-6' wherein driven chain wheel 5-2 is pivoted by a damping fly wheel 5-7, damping belt 5-8 or damping friction gear in order to produce frictional damping, and an accumulator, and said accumulator can accumulate electric power through pedalling the pedal driving element and dynamotor set 6-1 which is coupled by the damping fly wheel, and supply power to manual operational reaction training device, and when user makes passive exercise, said accumulator can supply electric power to said dynamotor set, and drive the pedal driving element for exerciser to make passive exercise; and a decorative plate 7 is screwed by screw on main bar 1-1 in order to cover pedal driving element; one end of a set of seat supporing rod 2-1 is pinned by the fixing pin 2-2 at one end of slightly inclined main bar 1-2, position of chair seat 2 can be slided and adjusted to let user recline or sit more comfortable, therefore, the whole structure can make exercise use his brain and limbs together, to stimulate his reaction and strengthen his body.

Figure 3:
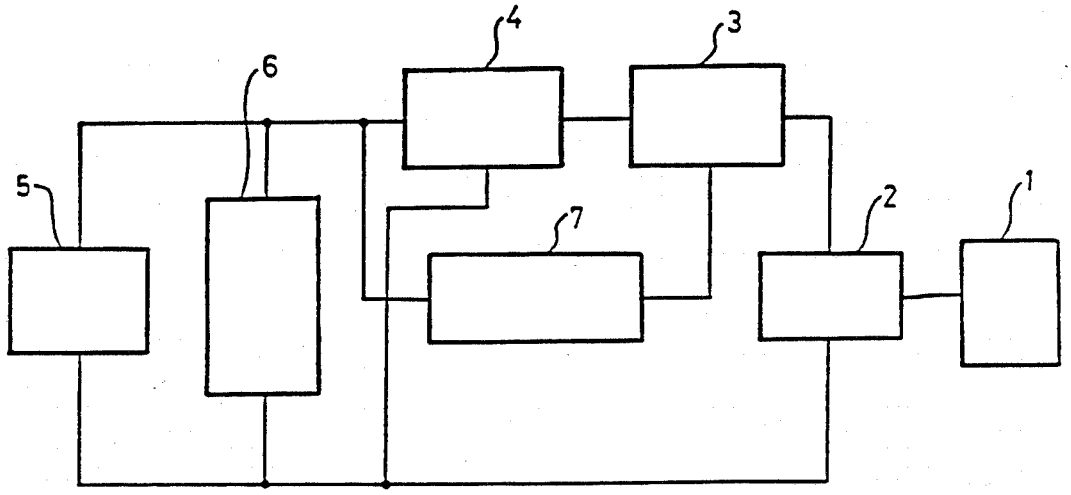
FIG. 3 is a circuit diagram of the reclining and sitting active passive exercise bike.

As shown in FIG. 3 it is a circuit diagram of the present invention, 1 is dynamotor set, 2 is clockwise and counterclockwise rotary selective switch, 3 is function selective device, 4 is stable votage circuit, 5 is manual operational reaction training device, 6 is accumulator, 7 is control circuit, dynamotor set 1 is selected by function selective switch 3 and used as dynamo or generator, when dynamo is in work, accumulator 6 supplies electric power, control circuit 7 controls the output of dynamics of dynamo, and output of clockwise and counterclockwise rotation is selected by clockwise and counterclockwise selective switch 2, and at this time, accumulator 6 simultaneously supplies electric power to manual operational reaction training device 5; when generator is in work, mechanical power transmitted from outside can let dynamo generate and produce stable output through stable voltage circuit 4 for the use of manual operational reaction training device and is transmitted into accumulator for storage.

Figure 4:
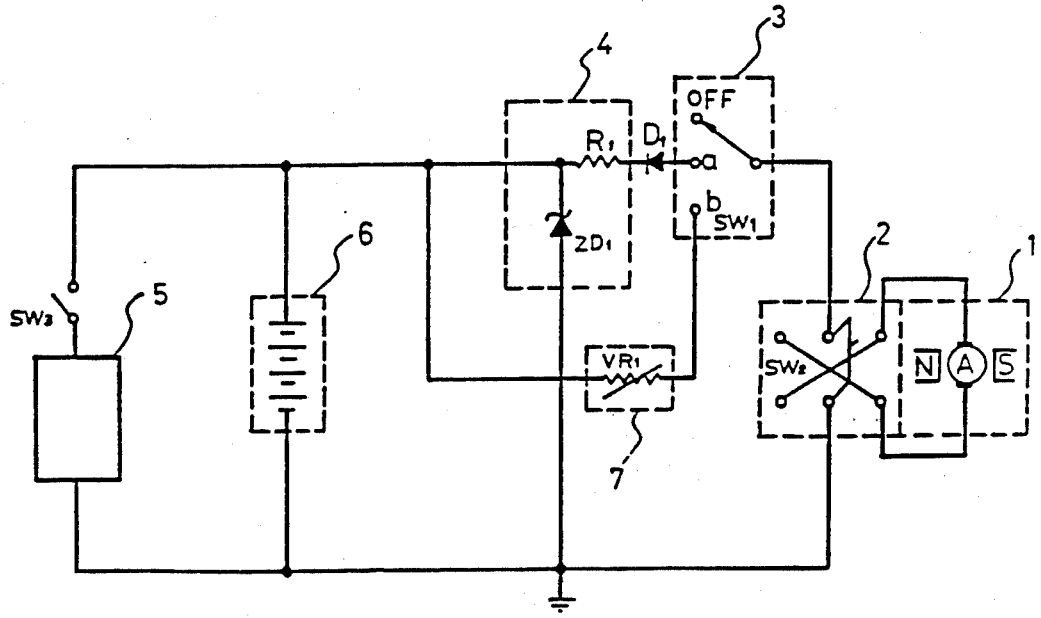
FIG. 4 is an embodiment of circuit of placing common armature dynamotor set.

As shown in FIG. 4, it is an embodiment of placing common armature dynamotor set, 1 is dynamotor set, 2 is single-pole double-throw switch, 3 is selective switch, 4 is stable voltage circuit, 5 is manual operational reaction training device, 6 is accumulator, 7 is variable resistance, when switch 3 is placed at position a, driving element is place to produce mechanical power and let dynamotor set generate and store electrical power to accumulator and supply electric power to manual operational reaction training device 5; in the same way, when switch 3 is placed at position b, accumulator supply electrical power to dynamotor set to let dynamotor set rotate and work, and it is used as dynamo and can let said driving element carry operator to make passive exercise driving, and through the function of single-pole double-throw switch, when it is placed at positive direction, then dynamo will carry the driving element to rotate in the positive direction, and exercise can make pulling exercise on leg muscle, when it is placed at reverse direction, then dynamo will carry the driving element to rotate in reverse, and exercise can make kicking exercise on leg muscle, variable resistance 7 is used to adjusted the strength of input electric power, that is to adjust the output dynamics of dynamo and it is suitable for different age and different condition of health, under such circumstance, accumulator also supplies electric power to manual operational reaction training device; characters of circuit in FIG. 4 are:

a set of amature DC common dynamotor set 1, two ends of armature are connected to two middle common joint of double-pole double-throw switch 2;

after crossing and communicating two ends of double-throw switch 2, one end is connected to ground wire, one point is connected to the common joint of selective switch 3 (SWI);

selective switch 3 (SWI) possesses OFF, a,b three position point;

after reaction training device which is driven by electricity is connected in series by switch SW3, then it is connected by battery 6 in series, and negative end is grounded;

diode D1 connected a resistance R1 in clockwise series from point a of selective switch 3 (SWI) to the positive end of battery;

a variable resistance R1 is connected in clockwise series from positive end of battery to point b of selective switch 3 (SWI);

stable voltage diode is connected in series by two ends of battery;

its operation is:

when SWI is OFF, it is under stopping status;

when SWI is at point a, dynamotor set 1 is driven in clockwise direction to produce electric power to accumulator or direct to load electricity, at this time, D1 is used to prevent the reverse current which is produced by pedalling in reverse, R1 and ZD, constitute stable voltage circuit, SW2 is used to select the direction of pedal;

when SWI is at point b, battery can drive dynamotor set for exerciser to make passive motion, SW2 can select direction, variable resistance VR1 is used for varying speed.

Figure 5:
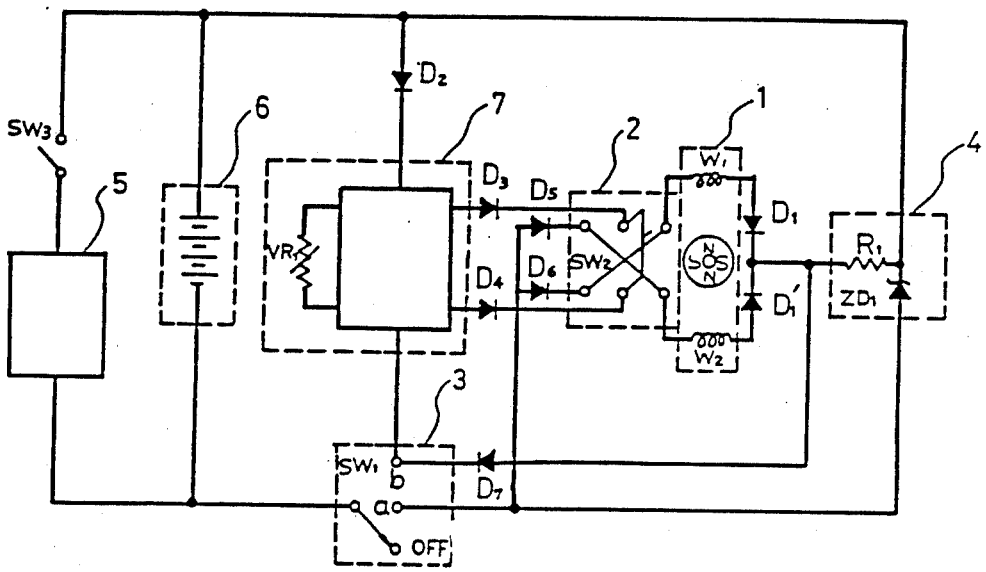
FIG. 5 is an embodiment of circuit of placing permanent magnet type two-phase step driving dynamotor set.

As shown in FIG. 5, it is an embodiment of placing permanent magnet type two-phase step driving dynamotor set, 1 is permanent magnet type multi-phase dynamotor set, 2 is single-pole double-throw switch set, 3 is selective switch, 4 is stable voltage circuit, 5 is manual operational reaction training device, 6 is accumulator, 7 is DC/AC converter; characters of circuit in FIG. 5 are:

a set of two-phase step common dynamotor set 1 which possesses permanent magnet or rotor;

after one end of two-phase coil connects diode D1 and D1' in clockwise direction, it is connected to one end of voltage drop resistance R1, and clockwise input end of diode D7;

another wire of two-phase coil is connected to the crossing and connecting two ends of double-pole double-throw switch 2 (SW2);

selective switch 3 (SWI) possesses a common joint and three output positions a, b, OFF;

two clockwise input ends of diodes is commonly connected to point b of selective switch 3 (SWI);

another end of R1 connects a stable voltage diode ZD, in parallel to positive end of battery;

negative end of stable voltage diode ZD, is connected to point b of selective switch 3 (SWI);

two output points of a DC/AC two-phase converter 7 connect diodes D5, D6 in clockwise series to two communicating points of SW2;

output end of diode D7 and input grounding end of DC/A/C converter joint commonly to point a of selective switch 3 (SW1);

input positive end of DC/AC converter 7 connects separate diode D2 in series to the positive end of battery;

communicating point of selective switch SW, communicates negative end of battery and negative end of electrical driving training device;

after positive end of manual operational reaction training device connects switch SW1 in series, and connects positive end of battery in parallel;

when switch 3 is placed at position a, driving element is pedalled to produce mechanical power and let dynamotor set generate and store electrical power to accumulator and supply electricity to manual operational reaction training device 5; in the same way, when switch 3 is placed at position b, accumulator supplies electrical power which is converted into AC by DC/AC converter and let dynamotor rotate, and at this time function of said dynamotor set is as same as dynamo, due to the function of single-pole double-throw switch, when it is placed at positive direction, then dynamo will carry the driving element to rotate in the positive direction, and exercise can make pulling exercise on leg muscle; when it is placed at reverse direction, then dynamo will carry the driving element to rotate in reverse, and exercise can make kicking exercise on leg muscle, at this time-accumulator also supplies electric power to manual operational reaction training device.

Figure 6:
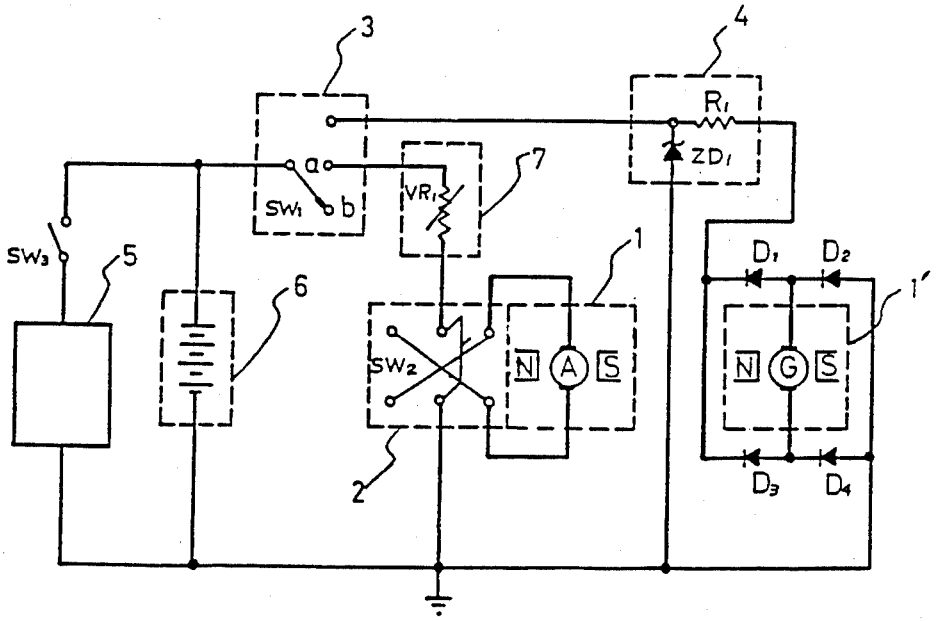
FIG. 6 is an embodiment of circuit of placing armature independent dynamo and generator set.

As shown in FIG. 6, it is an embodiment of placing armature independent dynamoland generator set 1', its function is as shown in FIG. 4, and dynamo and generator are placed singly; characters of circuit in FIG. 6 are:

a DC armature in which two ends connect in parallel two input points of bridge rectification in order to make clockwise output through bridge rectification when it is pedalled in clockwise and counter clockwise direction;

the positive pole output point of bridge rectification circuit which is constituted by diodes D1–D4 connects a voltage drop resistance R1 in series, negative pole is connected to grounding wire of circuit;

positive end of stable voltage diode ZD, and one end of R1 commonly connect point b to selective switch 3 (SW1);

selective switch 3 possesses a common joint and three output position points a, b, off;

armature set of a set of dynamotor set connects two output ends which cross and communicate two ends of double-pole double-throw switch 2 (SW2);

one end of two sets of common input end of double-throw switch 2 (SW2) is connected to the grounding wire, one point is connected to the grounding wire, one point is connected by a variable resistance VR1 in series to point a of selective switch 3 (SW1); negative end of electrical driving training device is grounded by regative end of battery in parallel, after positive input end connects a switch SW3 in series and then connect positive end of battery in positive end to common joint of selective switch; and its operation is:

when selective switch 3 (SW1) is off, machine is closed;

when selective switch 3 (SW1) is placed at point a, electric power drives the passive motion, current flows through variable resistance VR1, double-throw switch SW2, and armature, then flows back to negative pole through double-throw switch SW2, variable resistance VR1 is used to control speed, double-throw switch SW2 is used to control direction;

when selective switch 3 (SW1) is placed at point a, it is under active generating motion status, bridge rectification is used to generate in clockwise and counter clockwise driving, resistance R1 and stable voltage diode ZD is used to prevent voltage to be too high.

Figure 7:
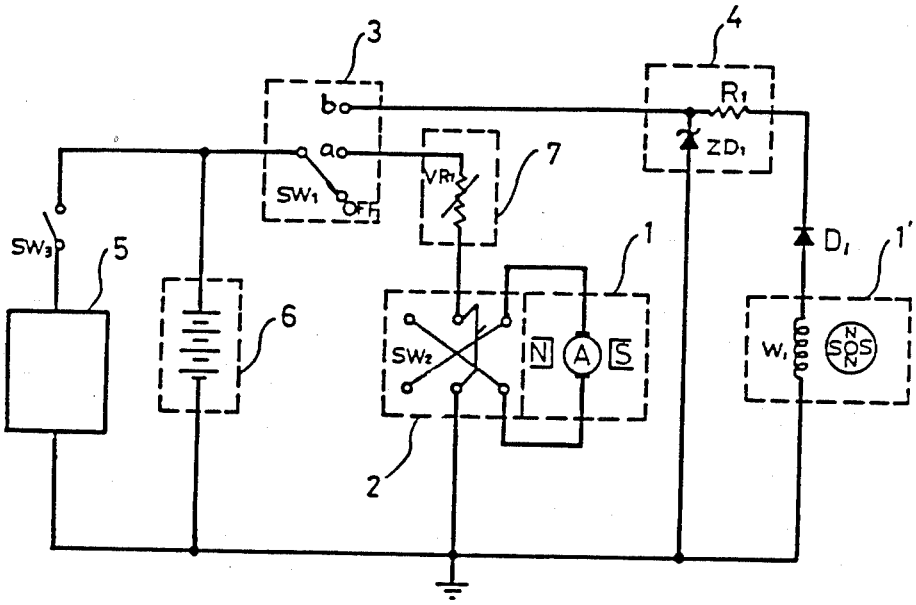
FIG. 7 is an embodiment of circuit of placing permanent magnet type multi-phase independent dynamo and generator set.

As shown in FIG. 7, it is an embediment of placing permanent magnet type multi-phase independent dynamo 1 and independent generator set 1', its function is shown in FIG. 5, and dynamo and generator are singly placed; character of circuit in FIG. 7 is that permanent magnet A.C. generator is used to substitute for armature DC generator as show in FIG. 6.

Figure 8:
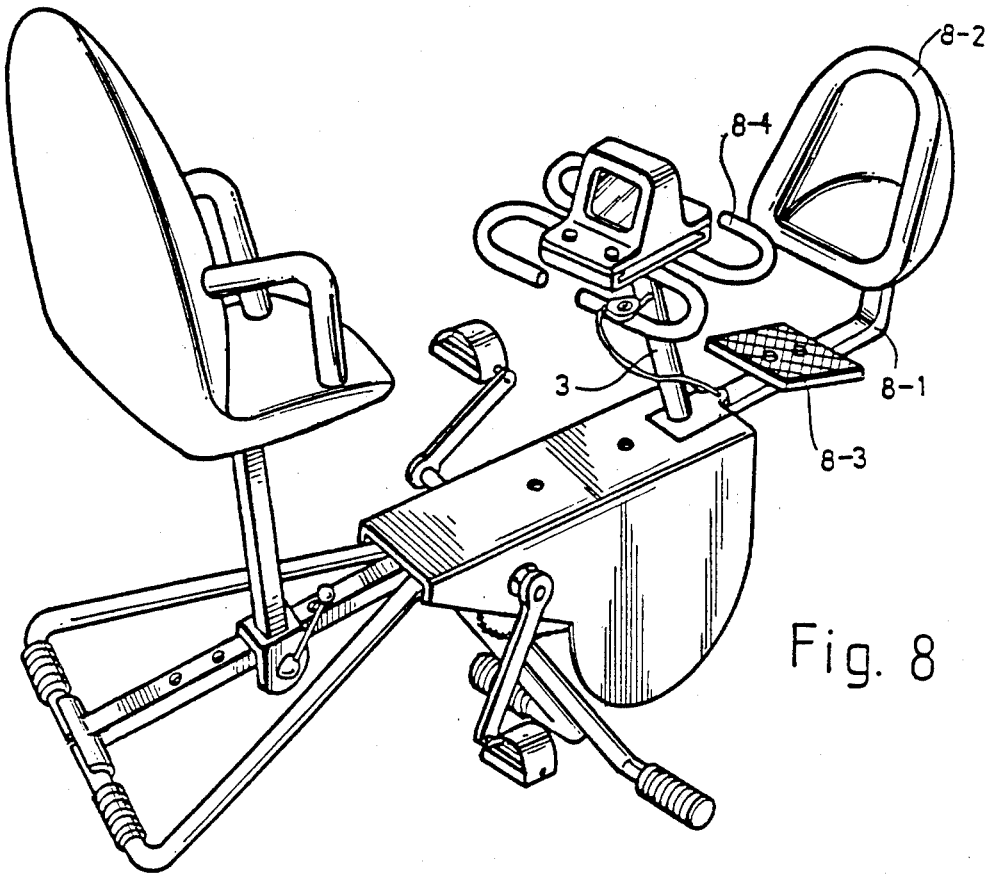
FIG. 8 is an graphic view of embodiment which possesses auxiliary chair.

As shown in FIG. 8, it is another embodiment of reclining and sitting, active passive exercise bike of the present invention, and its main characters are that an auxiliary chair is placed for the second one to participate in the activity, said auxiliary chair possesses "L" shape supporting rod 8-1, auxiliary seat 8-2, pedal 8-3 and handle 8-4; auxiliary seat 8-2 can adjust and slide position along supporting rod 8-1, and it is fixed and screwed by screw for the second one to select position; and pedal 8-3 is fixed and screwed by screw on the supporting rod 8-1 which is between handle bar frame and auxiliary seat for the second one to sit comfortably.

Figure 9:
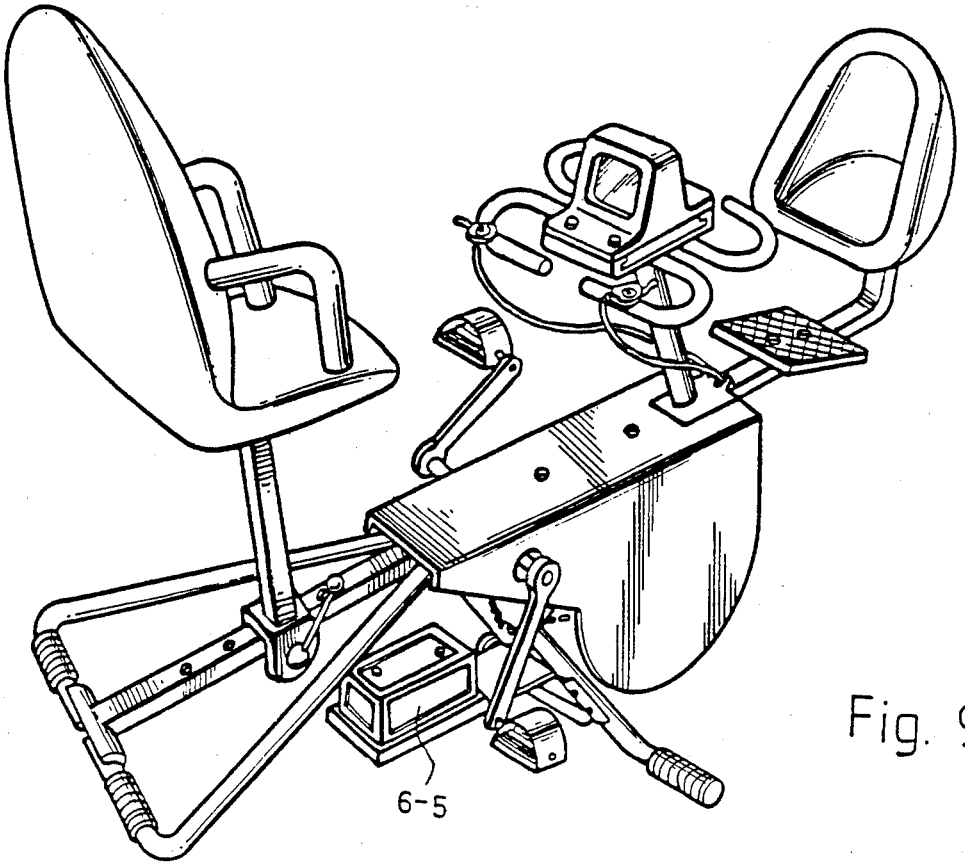
FIG. 9 is an graphic view of embodiment which possesses auxiliary chair and accumulator.

FIG. 9 is another enbodiment of the present invention in which besides an auxiliary chair, there also places an accumalator 6-5 for two exercisers to use the manual operational reation training device.

Figure 10:
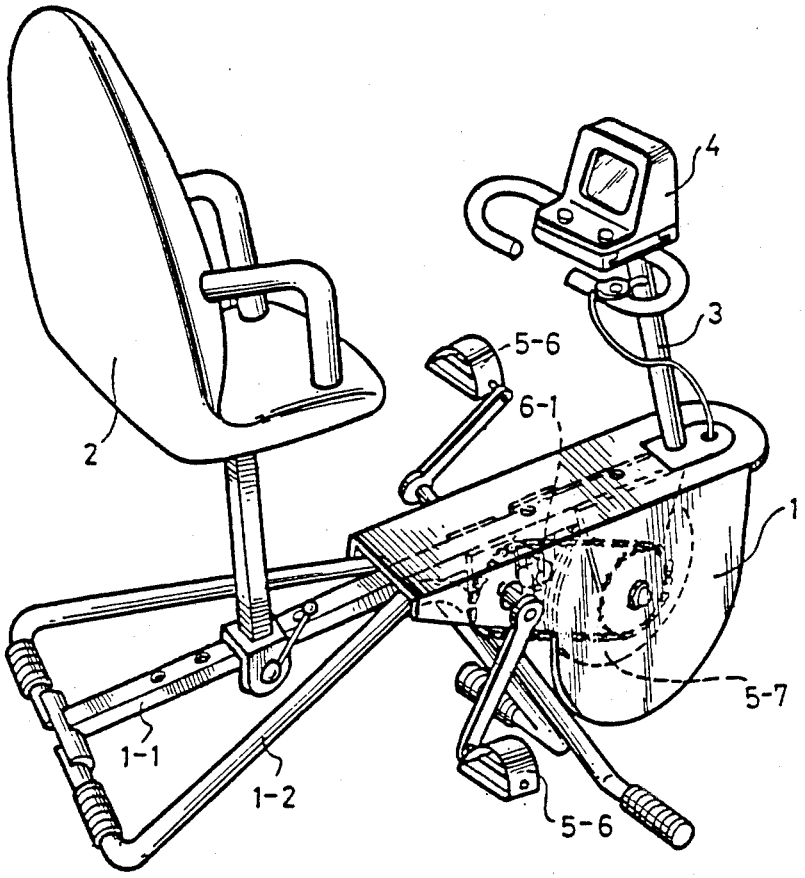
FIG. 10 is the embodiment of structure which has single set without accumulator.

FIG. 10 is the other embodiment of the present invention which possesses single set without accumulator to accumulate electric power.

Figure 11:
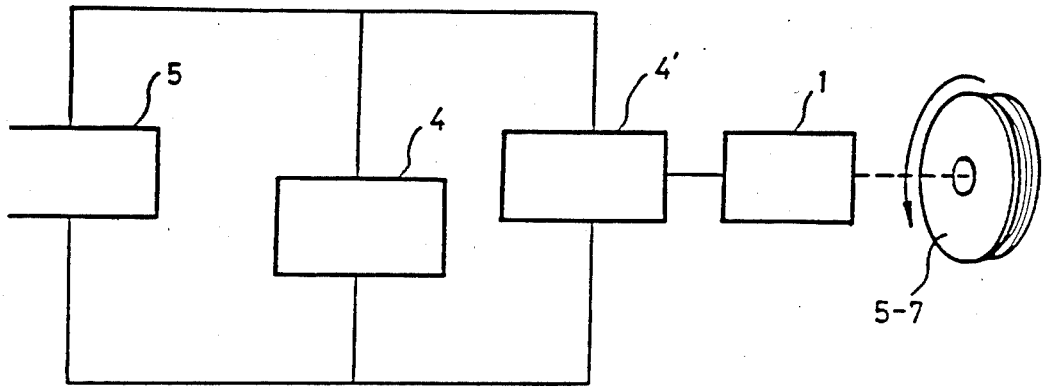
FIG. 11 is a circuit diagram of self-generating and driving reaction training device which possesses double functional fly wheel for stabilization and damping.

As shown in FIG. 11, it is a circuit diagram of self-generating and driving reaction training device which possesses double functional fly wheel for stabilization and damping, 1 is dynamotor set, 4 is stable voltage circuit, 4' is rectifying circuit, 5 is manual operational reaction training device, when wheel is driven and carried dynamo 1 generates and pass through the function of rectifying circuit stable voltage circuit to supply stable electric power to manual operational reaction training device.

Figure 12:
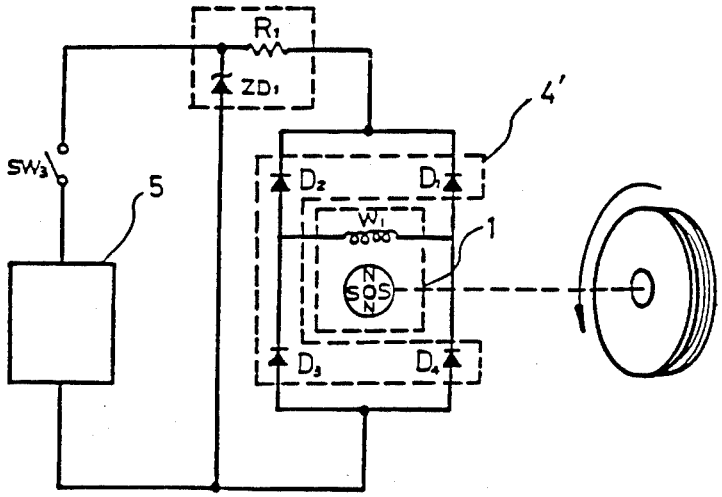
FIG. 12 is an embodiment of circuit of self-generating and driving reaction training device which possesses double functional fly wheel for stabilization and damping.

As shown in FIG. 12, it is an embodiment of circuit of self-generating and driving reaction training device which possesses double functional fly wheel for stabilization and damping, when usser pedals the driving element, due to damping function of fly wheel, it makes user must exhaust energy to overcome the damping and obtain the effectiveness of rehabilitation, and owing to the damping of fly wheel, it makes votage of dynamotor set be stably provided to manual operational reaction training device.

As shown in FIG. 13, it is a structural graphic crew of embodiment which possesses double driving and common reaction training device, and the structure of above-mentioned double driving device includes:

on a bike frame main body, there are two chairs 12, 12' two handle bar frames, and at least a set of reaction training devices 4;

two driving systems which are coupled to each other, and its character is that two sets of driving pedals are transmitted in the opposite direction and can commonly drive the loaded damping or generator;

driving gear having a set of chain wheels;

an adjusting structure having swing type adjuster to adjust the loose and tight condition between elements of the driving systems;

at least a set of damping devices;

at least a set of dynamotors used for producing electric power or as an element for driving dynamics.

Figures 1, 14:
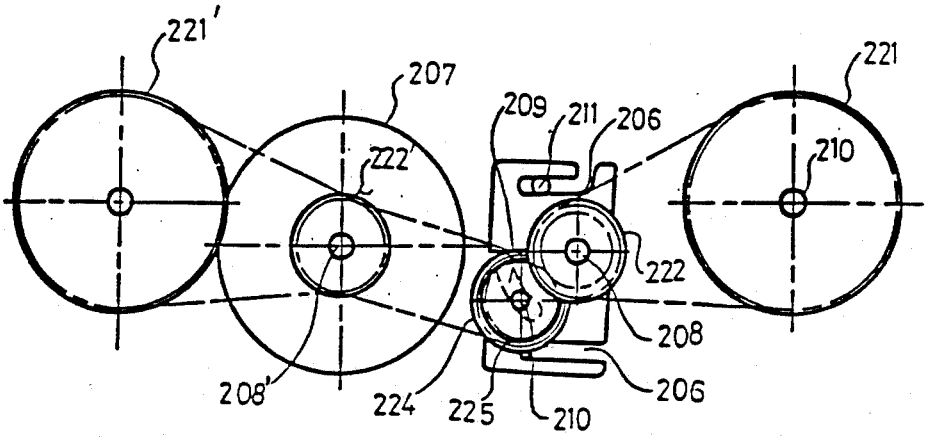
FIG. 14 is a perspective view of five-axle double driving and transfer adjusting structure.
Figures 2, 14:
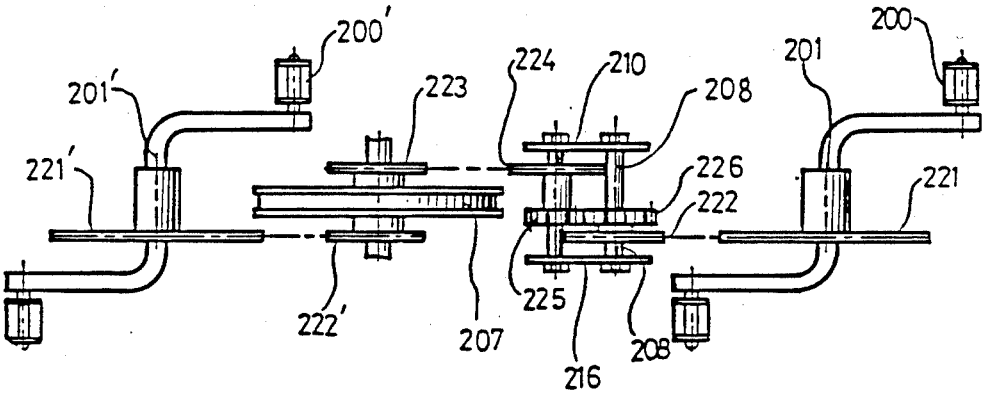
Figures 3, 14:
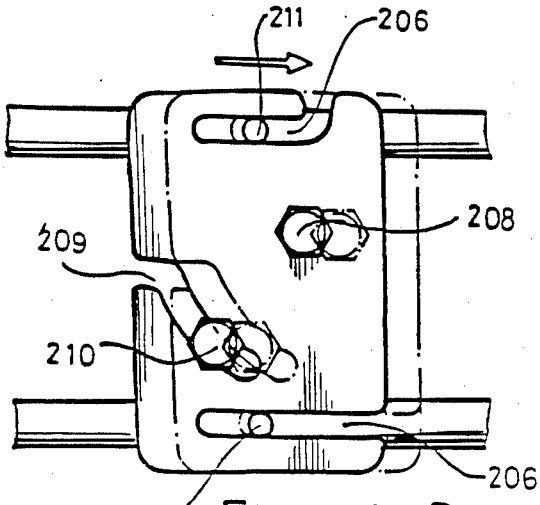
Figures 4, 14:
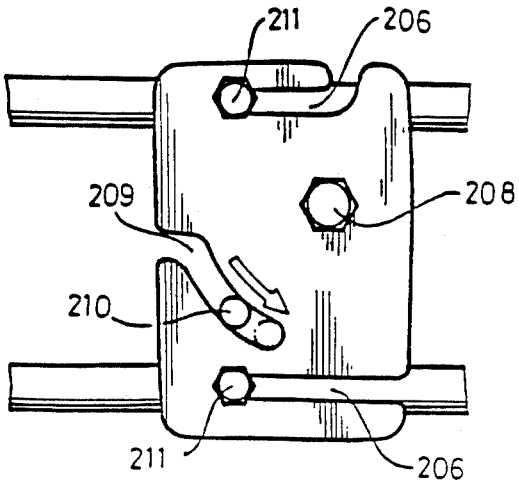

FIGS. 14–14-2 are the embodiments of this design, in figures, bike frame main body is a stationary frame, at two sides, there is a support rack for supporting chairs in the middle of bike frame, there are two sets of handle bars, between handle bar and bike frame main body, it can be jointed by common strut, or they respectively possess strut to join bike frame main body; two sets of pedal 200, 200' are respectively placed on the drive chain wheel axles 201, 201' at two ends of bike frame main body, two drive chain wheels 221, 221' drive two driven chain wheels 222, 222' by chains 203, 203'. The two driven chain wheels are coupled to each other by gear sets 225, 226. At least Damping flywheel 207 is placed on driven chain axle 208' in order to supply the damping required in motion; a set of concentric swing type adjuster process two concentric opening groove holes 206 and joint axle rods 211 at two ends of the bike frame with thread and is used for adjusting and fixing with a screw nut. At the swing device, there is a fixed driven chain wheel axle 208 and an arc groove 209 which can adjust the chain wheel by centering the fixed driven chain axle 208. This groove can be opened or sealed for penetrating a swingable adjusting axle 210 which possesses threads at two ends and can penetrate driving gear and is used for adjusting the looseness and tightness of chain, as shown in FIGS. 14-3–14-4. On the bike frame, there is a friction belt type friction gear for adjusting the damping, a set of manual operational reaction training devices, and a dynamotor set which can supply driving power when it is used to produce electric power or transmit electric power passively, and its futher characters is that in a driving system, a driven chain wheel axle with at least one direction possesses one-way bearing; and one of set of driven chain axle A possesses one-way driving bearing, between two input wheels, from A to B it makes dual driving; driven chain wheel axle B makes one-way driving to A, or both of two sets of driven chain wheel axle A,B possess one-way driving bearing in same direction, between input chain wheel axles A,B it can only make one-way mutual driving, it two sets of driven chain axle possess one-way bearing in different direction, and both of them are directly driven, wheel axles A,B may make dual driving each other.

Figure 15:
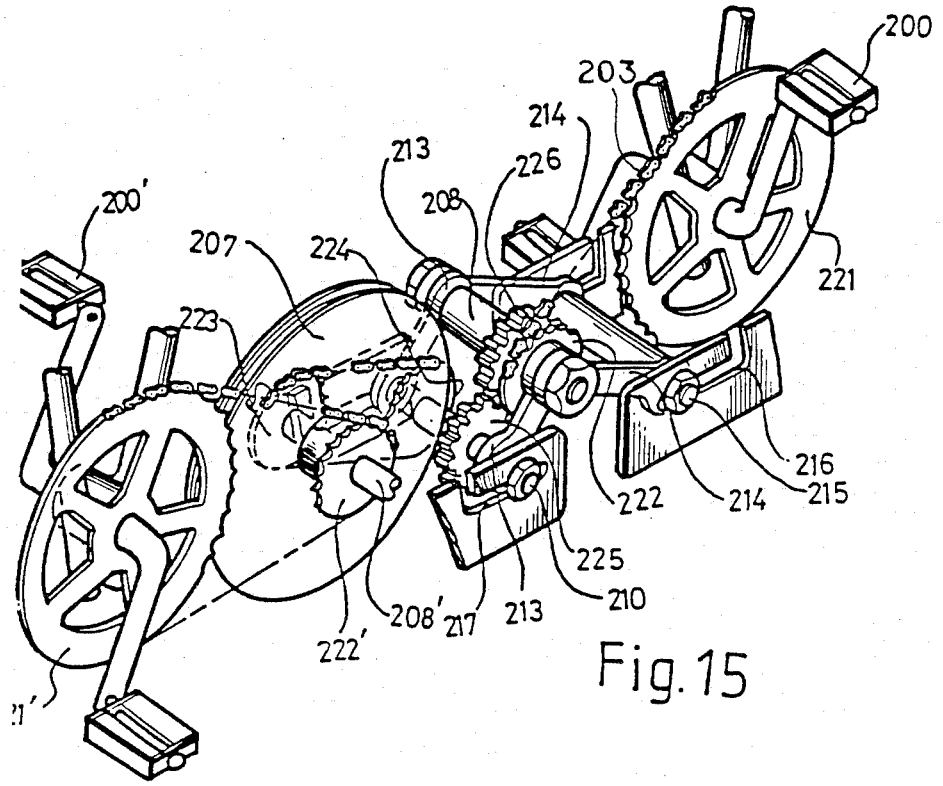
FIG. 15 is a perspective view of five-axle double driving and swingable adjusting structure.
Figures 1, 15:
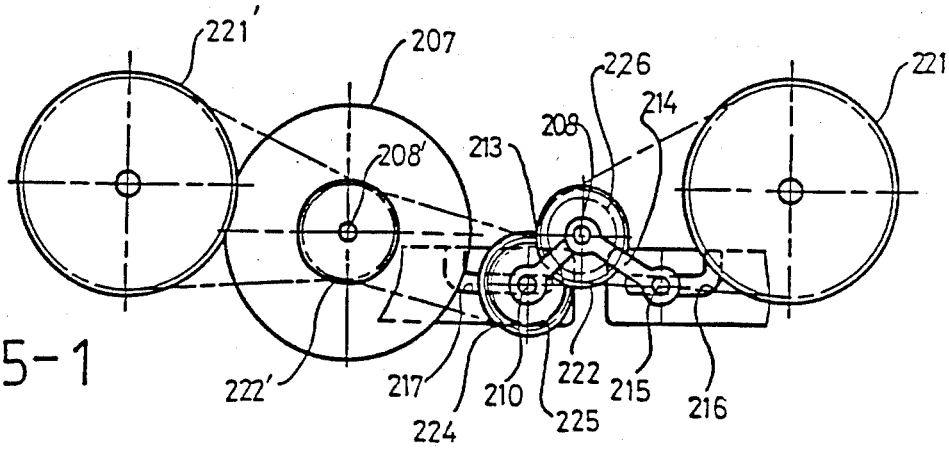
Figures 2, 15:
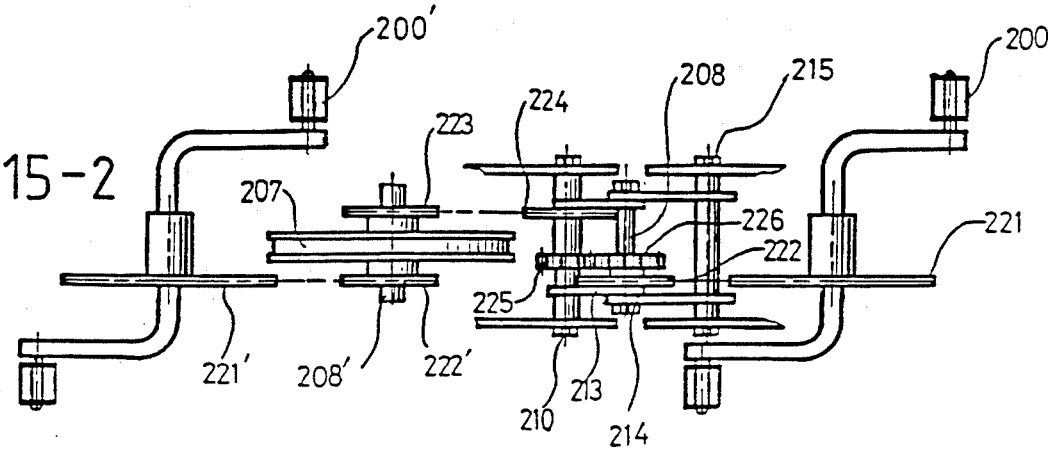

FIGS. 15–15-2 are another embodiment of above adjusting structure, characters of structure are:

A co-axial adjusting axle 210 which is penetrated by driving wheel 225 and driving chain wheel 224 with its two ends having threads and being fixed and screwed by screw nut in the adjusting groove 217 on the bike frame.

At two sides of the adjusting axle 210, there placed a pair of swingable branch handles 213. At another end of the branch handles 213, there are axle holes which are used to place driven chain wheel axle 208. At the same set, there is placed driving gear 226 conpled by gear 225, and chain wheel 222 which is coupled by chain wheel 221.

At two sides of coaxial driven chain wheel axle 208, there are a pair of branch handles 214 for adjustment. At another end of a branch handle 214, there is an axial rod 215. The axial rod has threads is placed in the adjusting groove 216 on the bike frame, and is fixed, locked and adjusted by a screw nut.

Above-mentioned mutual driving is used for rehabilitated people or when the passive exerciser is under the driven status. The active driver pedals the pedal actively, and the leg muscles of the rehabilitated person or passive exerciser is exercised through loose passive joint exercise, and its function is as same as a rehabilitation massage of the bending joints. Also the arm cam swing forward and backward matching with the rhythm and this can further have the effectiveness of rehabilitation.

Figure 16:
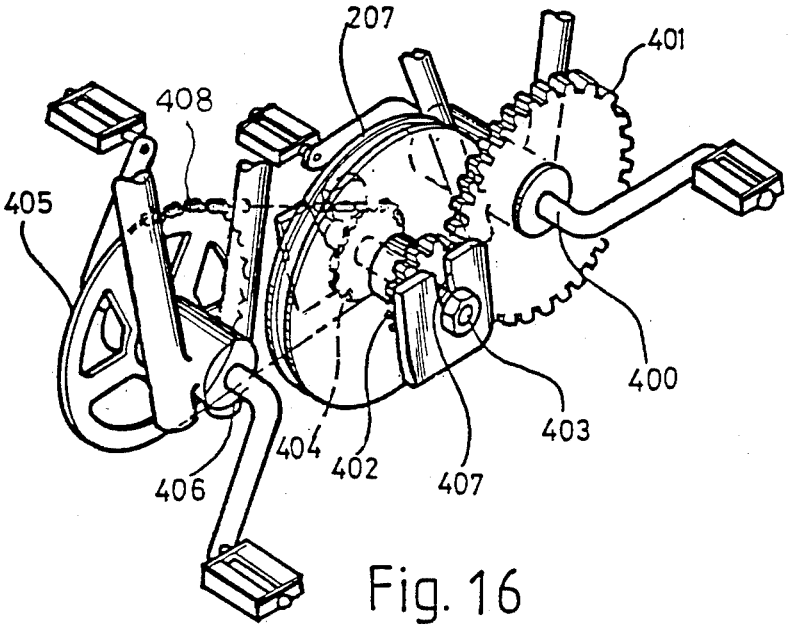
FIG. 16 is a perspective view of double driving tri-axle driving structure.
Figures 1, 16:
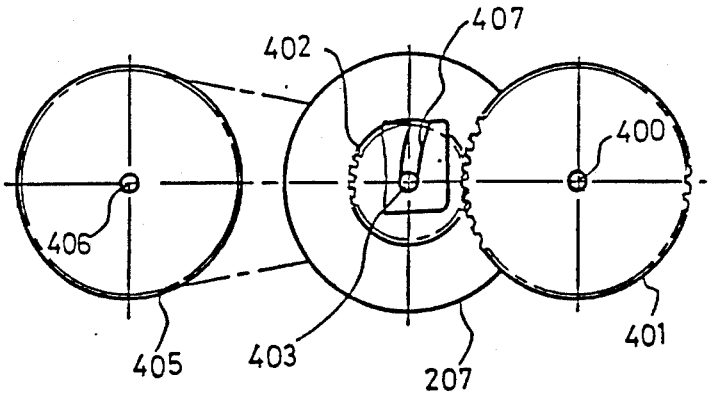
Figures 2, 16:
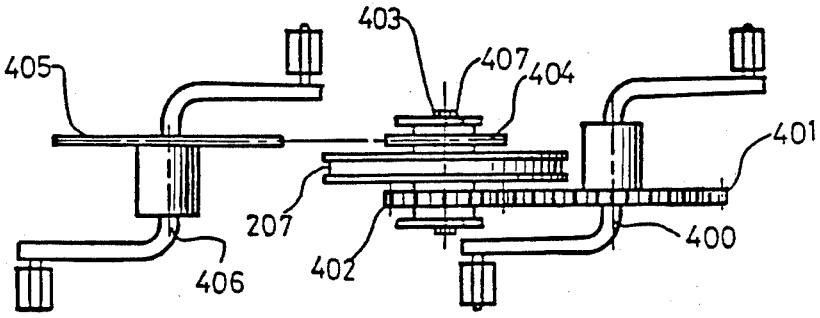

FIGS. 16–16-2 are an embodiment of tri-axle a structure, wherein a drive axle is jointed by a drive gear 401 and driven gear 402, at driven axle 403, there is chain wheel 404 to couple with chain wheel 405 of drive axle 406 and constitute tri-axle double drive and driven structure. Its main structure is as same as above embodiment, but its structure of an adjusting device is centered by a gear type input drive axle 400 and the distance of two gear axles is used as the radius to form an opening or sealed type semi-circular groove 407 for penetrating and placing driven gear and driven chain wheel common axle rod 403 for adjusting the looseness and tightness of chain of another axle 406. Two ends of common axle rod 403 also possess threads for fixing and locking. The flywheel type damping device or disc frictional damping device is placed on a common axial rod.

Figure 17:
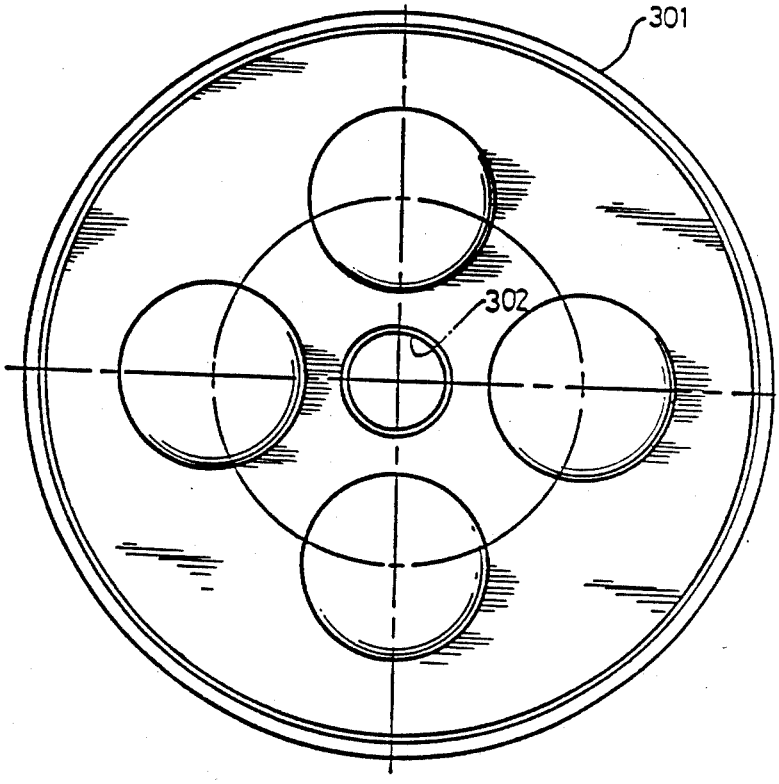
Figures 1, 17:
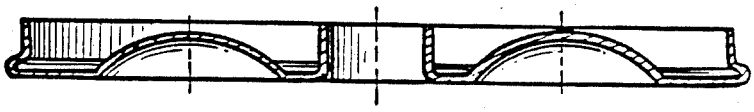
Figures 2, 17:
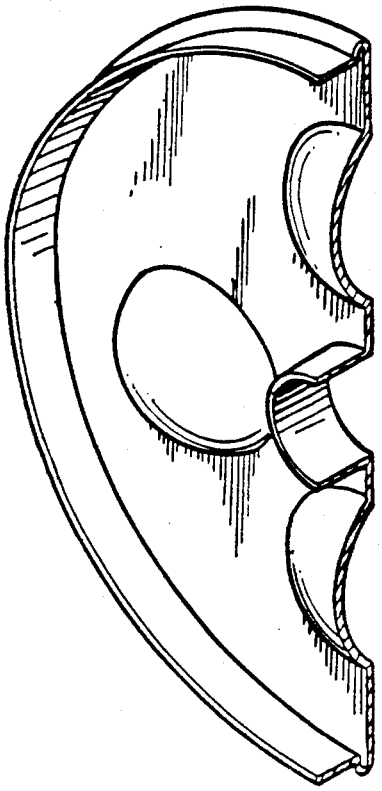

In the above-mentioned each embodiment, a damping fly wheel must possess a larger inertia in order to reduce the pulse of speed which is caused by the decrement of damping and it can be reached by the traditional solid flywheel. Now in the market, usually, it is made of 10–20 kgs cast iron, its cost is about ¼ of total cost. The futher design of the present invention is the improvement of damping flywheel, and its character is that it is a hollow wheel which is pressed by metal plate and is filled by low cost concrete, i.e. concrete or water to provide a low cost flywheel, its constitutive characters include:

As shown in FIGS. 17–17-2, two flywheel hubs 301 which are round metallic thin plate cup-shaped structures. At the flywheels middle part there fixing hole 302 which includes a concave ring edge, outer the ring is a ladder type structure with a smaller diameter near joining surface.

Figure 18:
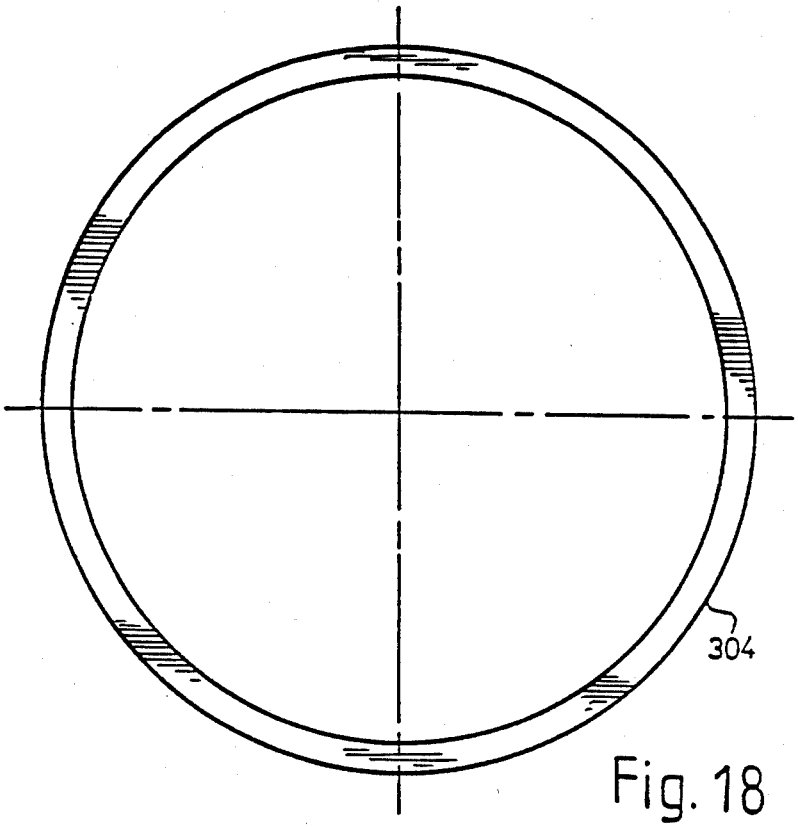
Figures 1, 18:
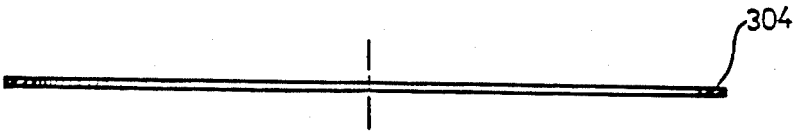

As shown in FIGS. 18–18-1, a ring type seal ring 304 is made of rubber or other soft flexible material and is placed between the two cup type structures. The sides of the above two cup-shaped structures possess concave and convex pattern surfaces which are used to fix concrete or in it there possesses metallic strip which is fixed and placed at rib of flywheel hub.

Figure 19:
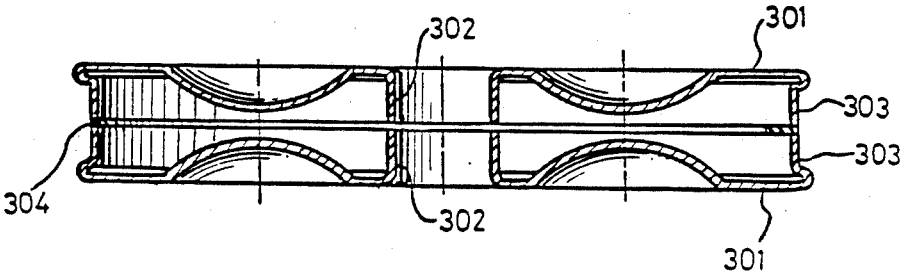
FIG. 19 is the combination of hollow flywheel.
Figures 1, 19:
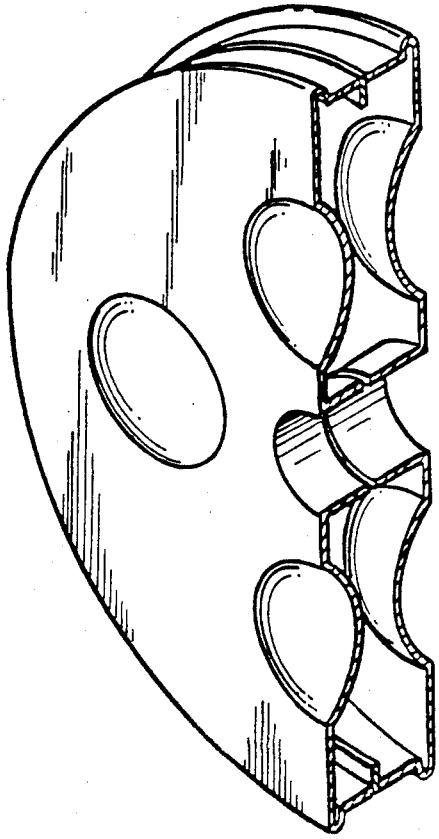

FIGS. 19–19-1, are the combination and perspective views of this kind of flywheel. The merit of this design is to lower by approximately 40 percent the costs of a flywheel.

Summing up, the present invention provides an auxiliary chair for the second one to join in the activity. It promotes interest of exercise and also possesses a manual operational reaction training device to use the hands and brain together. The exerciser can pedal the pedal to make active motion and passive training and therefore, it is a reclining and sitting exercise bike which can execute action of rehabilitation and training together.

I claim:

1. A double functional exercise bike comprising:

a bike frame main body;

two chairs attached to said body;

two handle bar frames attached to said body;

at least one reaction training device;

a damping device;
a driving system having
a first axle;
a second axle;
a third axle;
a first pedal set mounted on said first axle;
a second pedal set mounted on said third axle;
a drive gear;
a driven gear; and
a chain wheel mounted on said first axle; and a first chain placed on said first chain wheel;
so that said first and second pedals provide rotating forces in opposite directions and commonly drive said damping device; and
means for adjusting the tension on said first chain.

2. A double functional exercise bike comprising:
a bike frame main body;
two chairs attached to said body;
two handle bar frames attached to said body;
at least one reaction training device;
a generator;
a driving system having
two sets of pedals, each set mounted to an axle, which provide rotating forces in opposite directions and which commonly drive the generator;
means for adjusting the tension on the driving system; and
a dynamotor for producing electric power to be used as a driving source.

3. A five-axle double-function exercise bike comprising:
a bike frame main body;
two chairs attached to said body;
two handle bar frames attached to said body;
at least one reaction training device;
a driving system having;
first and fifth axles placed at opposite ends of said bike frame main body,
a first pedal set connected to said first axle;
a second pedal set connected to said fifth axle;
first and second drive chain wheels mounted on said first and fifth axles;
first and second chains placed around said first and second drive chain wheels;
first and second driven chain wheels coupled to said drive chain wheels by means of said chains;
a second axle supporting said first driven chain wheel;
a third drive chain wheel mounted on said second axle;
a damping device mounted on said second axle;
a third chain placed around said third drive chain wheel;
a third driven chain wheel coupled to said third drive wheel by means of said third chain;
a third axle supporting said third driven chain wheel;
a drive gear mounted on said third axle;
a driven gear coupled to said drive gear; and
a fourth axle supporting said driven gear and supporting said second driven chain wheel, so that said first and second pedals provide rotating forces in opposite directions and commonly drive said damping device; and
means for adjusting the tension on said chains including at least one set of concentric swing-type adjusters attached to said bike frame main body for securing at least one axle to the main body and for allowing another axle to be swingable.

4. An exercise bike as in claim 3 wherein said damping device is a flywheel.

5. An exercise bike as in claim 4 wherein
said bike frame main body futher comprises one protrusion on each side; and
wherein said adjusting means concentric swing-type adjusters further comprise two groove-shaped apertures, a circular aperture, and an arc-chaped aperture, with said protrusions being inserted into said groove-shaped apertures so that said adjuster can be secured to said bike frame main body, with said fourth axle being inserted into said circular aperture so that said fourth axle can be secured to the adjuster and held stationary relative to said bike frame main body, and with said third axle being inserted into said arc-shaped aperture so that said third angle is swingable and adjustable relative to said stationary fourth axle and said bike frame main body.

6. Damping flywheel as in claim 5 wherein said flywheel is pressed by a metal plate and filled with low cost concretion, i.e. concrete or water, to provide a low cost flywheel, said flywheel comprises:
two sets of flywheel hubs, each hub having:
a round metallic thin plate cup-shaped structure so that four hubs together constitute a flywheel;
inner edges forming concave rings so that when all four hubs are together a fixing hole is formed;
outer edges having a ladder type structure so that the hub-joining ends of the outer edges have a smaller diameter relative to the other outer ends of said hubs; and
sides having concave and convex pattern surfaces used to fix concrete or in it there possesses metallic strip which is fixed and placed at rib of flywheel hub; and
a set of ring type seal rings made of rubber or other soft flexible material and placed between two adjoining hubs.

7. A exercise bike as in claim 4 wherein said adjusting means further comprises:
an axial rod;
a pair of first swingable branch handles, each having axle holes at each end, a first end of said branch handles being placed around said third axle and a second end of said first branch handles being placed around said fourth axle;
a pair of second swingable branch handles, each having axial holes at each end, a first end of said second branch handles being placed around said fourth axle, and a second end of said second branch handles being placed around said axle rod; and
wherein a first set of said concentric swing-type adjusters, each being connected to said main bike frame main body and having an aperture, said axle being inserted into each of said first adjuster apertures; and
wherein a second set of said concentric swing-type adjusters each being connected to said bike frame main body and having an aperture, said axial rod being inserted into each of said second adjuster apertures so that said third axle, axial rod, branch handles, and fourth axle can be adjusted, fixed and locked to vary the tightness of the chains.

8. Damping flywheel as in claim 7 wherein said flywheel is pressed by a metal plate and filled with low cost concretion; i.e. concrete or water, to provide a low cost flywheel, said flywheel comprises:

two sets of flywheel hubs, each hub having:

a round metallic thin plate cup-shaped structure so that four hubs together constitute a flywheel;

inner edges forming concave rings so that when all four hubs are together a fixing hole is formed;

outer edges having a ladder type structure so that the hub-joining ends of the outer edges have a smaller diameter relative to the other outer ends of said hubs; and sides having concave and convex pattern surfaces used to fix concrete or in it there possesses metallic strip which is fixed and placed at rib of flywheel hub; and a set of ring type seal rings made of rubber or other soft flexible material and placed between two adjoining hubs.

9. A three-axle double function exercise bike comprising:

a bike frame main body;

two chairs attached to said body;

two handle bar frames attached to said body;

at least one reaction training device; and a driving system having:

a first axle being the drive axle;

a set of first pedals attached to said first axle;

a first chain wheel mounted on said first axle;

a chain placed on said first chain wheel;

a second chain wheel coupled to said first chain wheel by means of said chain;

a second axle penetrated by said chain wheel and being commonly driven;

a damping device mounted on said second axle;

a driven gear mounted on said second axle;

a drive gear coupled to said driven gear;

a third axle connected to a center of said drive gear, being a gear-type input drive axle;

a set of second pedals attached to said thru axle; so that said first and second pedals provide rotating forces in opposite directions and commonly drive said dampling device; and means for adjusting the tension on said chains including a set of concentric swing-type adjusters having a semi-circular groove shape defining an aperture, said adjusters being connected to said bike frame main body, said second axle being inserted into the aperture of said adjusters so that said second axle is adjustable on a vertical direction relative to said bike frame main body.

10. An exercise bike as in claim 9 wherein said damping device is a flywheel.

11. Damping flywheel as in claim 10 wherein said flywheel is pressed by a metal plate and filled with low cost concretion, i.e. concrete or water, to provide a low cost flywheel, said flywheel comprises:

two sets of flywheel hubs, each hub having:

a round metallic thin cup-shaped structure so that four hubs together constitute a flywheel;

inner edges forming concave rings so that when all four hubs are together a fixing hole is formed;

outer edges having a ladder type structure so that a smaller diameter is near the hub-joining ends of the outer edges have a smaller diameter relative to the other outer ends of said hubs; and sides having concave and convex pattern surfaces used to fix concrete or in it there possesses metallic strip which is fixed and placed at rib of flywheel hub; and a set of ring type seal rings made of rubber or other soft flexible material and placed between two adjoining hubs.

12. An exercise bike as in claim 9 wherein said damping device is a disc frictional damping device.

* * * * *